United States Patent [19]

Perrot

[11] 4,215,532

[45] * Aug. 5, 1980

[54] MECHANICAL WATCH MOVEMENT

[75] Inventor: Frieddrich Perrot, Lengnau, Switzerland

[73] Assignee: Eta A. G. Ebauches-Fabrik, Grenchen, Switzerland

[ * ] Notice: The portion of the term of this patent subsequent to Jun. 5, 1996, has been disclaimed.

[21] Appl. No.: 962,667

[22] Filed: Nov. 21, 1978

Related U.S. Application Data

[63] Continuation of Ser. No. 748,182, Dec. 7, 1976, Pat. No. 4,157,008.

[30] Foreign Application Priority Data

Dec. 12, 1975 [CH] Switzerland ..... 16170/75

[51] Int. Cl.[2] ..... G04B 17/00

[52] U.S. Cl. ..... 368/168; 368/171

[58] Field of Search ..... 58/109, 114, 115, 110–113, 58/116 R, 107, 108, 117, 136, 137

[56] References Cited

U.S. PATENT DOCUMENTS 3,350,875 11/1967 Siefert et al. ..... 58/115 X

FOREIGN PATENT DOCUMENTS 2333446 1/1975 Fed. Rep. of Germany ..... 58/114
2182575 12/1973 France .
583522 10/1958 Italy ..... 58/115

*Primary Examiner*—Ulysses Weldon
*Attorney, Agent, or Firm*—Stevens, Davis, Miller & Mosher

[57] ABSTRACT

A mechanical watch movement of the type wherein a balance-cock supports a balance arranged to pivot in bearings about a fixed axis, and a balance-spring is fixed at its inner end to the balance and at its outer end to a bent arm of a thin, blanked plate constituting a support member detachable from the remainder of the movement.

1 Claim, 4 Drawing Figures

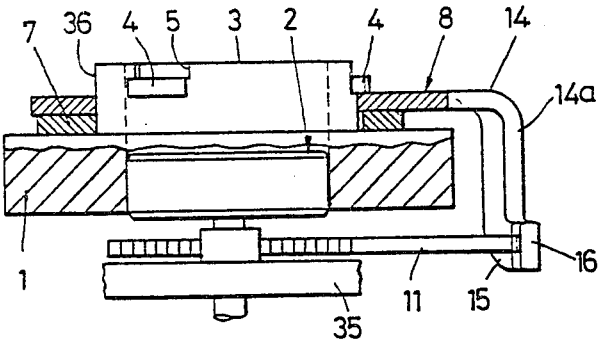
FIG. 1
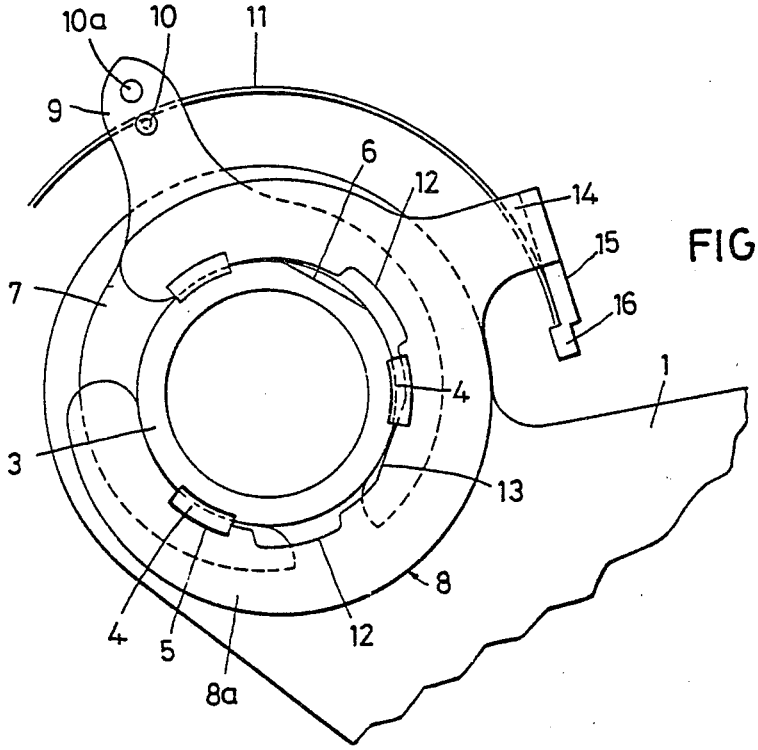
FIG. 2
FIG. 3
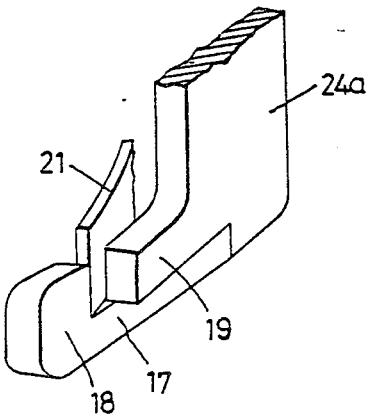
FIG. 4
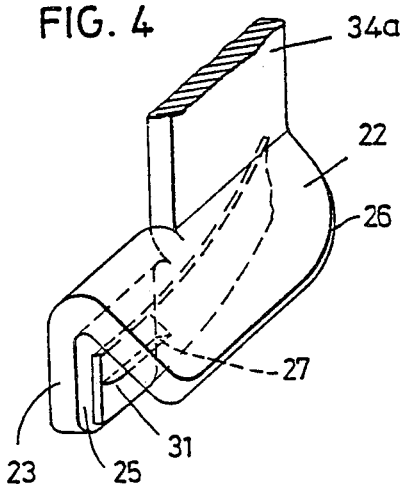

MECHANICAL WATCH MOVEMENT

This application is a continuation of application Ser. No. 748,182 now U.S. Pat. No. 4,157,008.

This invention relates to a mechanical watch movement of the type wherein a balance-cock supports a balance arranged to pivot in bearings about a fixed axis, and a balance-spring is fixed at its inner end to the balance and at its outer end to a bent arm of a thin, blanked plate constituting a support member detachable from the remainder of the movement.

In conventional watch movements, the outer end of the balance-spring is generally fastened to the frame of the movement by a stud having a transverse hole in which the balance-spring is fixed by a pin. In most cases, the stud is mounted on a stud-support, a plate-shaped element disposed rotatingly about the axis of the balance so that its position may be adjusted.

In order to simplify these devices, it has already been proposed to fix the outer end of the balance-spring to its support member by cementing or welding; for at the present time, welding and cementing techniques provide methods suitable for bonding parts as fine and as delicate as the end of a balance-spring of a watch movement to a frame element of such a movement.

French Utility Certificate No. 2,182,175 describes a stud-support having an annular portion intended to be resiliently engaged on the cock endstone or on an annular rib of the balance-cock, and having an arm blanked and bent so as to form a central tongue extending on each side of two lateral tongues. The last turn of the balance-spring is engaged between these tongues and fixed by cementing or welding. Swiss Pat. No. 510,903, on the other hand, describes a balance-spring support member consisting of a blanked and bent plate acting as an endstone and comprising an arm, the end of which is bent back on itself.

Experience has shown, however, that fixing a balance-spring to its support member by cementing or welding requires that the end of the support arm be shaped so as to conform to certain imperatives, for the outer end of the balance-spring must be put in place without being deformed and fixed without being displaced. In the case of welding, those areas of the support member and of the balance-spring which are made molten in order to produce the bond must meet or almost meet when welding takes place. Hence the end portion of the balance-spring has to be guided and pressed against supporting elements when being put in place. In the case of cementing, on the other hand, it is necessary for the end portion of the balance-spring to extend without deformation, i.e., freely, opposite surfaces which form a receptacle so that the cement, when melting, can accumulate at the bottom of this receptacle and will not run out the wrong way. Moreover, the end portion of the balance-spring, while being perfectly positioned, must allow a certain clearance to exist between it and the inner faces of the receptacle.

Furthermore, in order for the advantages of increased efficiency deriving from fastening by welding or cementing to be properly exploited, the support member itself must be as simple as possible to manufacture; in particular, it must require only the operations of blanking and bending a piece of sheet metal for its manufacture and shaping.

Finally, since bonds produced by cementing or welding are permanent, the support member must be mounted on the frame element which supports the balance in such a way that it can easily be removed to allow overhauling or adjustments during servicing. The prior art watch movements do not satisfy these various requirements.

It is an object of this invention to provide a means of securing the outer end of the balance-spring to the frame of the movement which satisfies all the favorable requirements mentioned above so as to enable the production of an improved, low-cost watch movement in which the balance-spring is permanently secured to its support member without being deformed, the oscillator being easy to dismantle for purposes of overhaul or repair.

To this end, in the watch movement according to the present invention, of the type initially described, the improvement comprises at least two blanked and bent and/or stamped fixing elements disposed at the end of the arm of the support member and embracing at least two faces of the outer end of the balance-spring, and a bond integral with at least one of the fixing elements and with at least one of the mentioned faces for securing that element to that face.

Preferred embodiments of the invention will now be described in detail with reference to the accompanying drawing, in which:

FIG. 1 is an elevation, partially in section, showing the balance-cock and the stud-support in a first embodiment of the watch movement, FIG. 2 is a top plan view of the device for fixing the balance-spring to the frame, FIG. 3 is a broken-away perspective view on a larger scale of the fixing device in a second embodiment, and FIG. 4 is a view analogous to FIG. 3 in a third embodiment.

The watch movement illustrated in FIGS. 1 and 2 comprises a balance-cock 1 which is secured by means (not shown) to a plate and which holds a bearing 2 intended to support one end of the staff of a balance 35 constituting the main part of the oscillator of the movement. A collet or circular rib 3, projecting from the upper surface of the balance-cock 1, has three projecting catches 4 situated about halfway up its height and distributed along its cylindrical side surface 36 at 120° from one another. The catches 4 may be formed in various ways, e.g., by stamping, using a tool which partially blanks grooves 5 in the upper portion of the side surface 36. A flat 6 extending over the entire height of the surface 36 is situated between two of the catches 4. The remainder of the side surface 36 of the collet 3 serves to guide a regulator 7 and a stud-support, designated as a whole by reference numeral 8, placed above the regulator 7. The parts 7 and 8 each comprise a split annular portion surrounding the collet 3 and are each formed from a flat plate shaped by blanking. The regulator 7, which rests directly upon the upper face of the balance-cock 1, includes a lug 9 in which there are fixed a pin 10 and a key 10*a* which embrace the outer turn of a balance-spring 11 in a known manner. The annular portion of the regulator 7 is fitted on the collet 3 before the catches 4 are formed, and its inside diameter is slightly less than the diameter of the collet 3 so as to produce a friction-tight fit on the collet 3. As for the stud-support 8, which constitutes the support member for the balance-spring 11, it comprises an annular portion 8*a*, the inside edge of which is blanked to form an arc of a circle having two notches 12 and a slot, arranged so as to allow the stud-support 8 to be fitted freely over the collet 3 and the three catches 4. Thus the stud-support 8 may be fitted on the regulator 7 and fixed by means of a rotary movement so that the three catches 4 overhang portions of the stud-support 8 where there are no notches 12. This mode of fixation is analogous to a bayonet fitting. The arcuate inside edge of the annular portion 8*a* of the stud-support 8 further includes a flat 13 having the same dimensions as the flat 6. Thus the stud-support 8 may be adjusted with respect to the collet 3 with sufficient play to enable it to engage freely on the side surface 36 of the collet 3. During the rotary movement imparted to the stud-support 8 for hooking it under the catches 4, the flat 13 comes to rest against the cylindrical portion of the side surface 36 of the collet 3 and ensures a certain grip of the annular portion 8*a* on the periphery of the collet 3. This arrangement prevents any inopportune displacement of the stud-support 8 in the event of a shock or during alteration of the daily rate by means of the regulator 7, but nevertheless allows rotation when the watch is put into beat.

The stud-support 8 is a flat plate shaped by blanking and bending which comprises, besides the annular portion 8*a* already described, a lateral arm 14, the outer end portion 14*a* of which is bent at a 90° angle along a line tangent to the end of the balance-spring 11 and extends parallel to the axis of the balance 35. The bent portion 14*a*, which forms a supporting element for the outer end of the balance-spring 11, is blanked and stamped so as to exhibit at its lower end a straight guide element 15, which extends tangentially to the balance-spring 11, and a positioning beak 16 formed by stamping or partial blanking, the inner edge of which determines the position of the outer end of the balance-spring 11. The balance-spring 11 is secured to the element 15 by laser welding in a direction substantially parallel to the axis of the balance 35, the end face of the balance-spring 11 resting against the beak 16. Thus the bond is permanent, and when the oscillator is dismantled, the stud-support 8 will be separated from the balance-cock 1 after having been rotated to bring each of the two notches 12 and the slot opposite a respective one of the catches 4.

The embodiments partially illustrated in FIGS. 3 and 4 are analogous in structure to the embodiment shown in FIGS. 1 and 2. They differ from the latter in the means employed for securing the outer end of the balance-spring to the stud-support.

Thus, in FIG. 3, the lower end of a supporting element 24*a*, forming part of a stud-support which is otherwise similar to the stud-support 8, is to be seen. The supporting element 24*a* comprises at its base a support tongue 17 ending in a positioning beak 18. Extending immediately above the support tongue 17, which is slightly bent inwardly, is a guide tongue 19 which is separated from the support tongue 17 by a simple slot. The guide tongue 19 is shorter than the support tongue 17, so that there is a space between the inner edge of the positioning beak 18 and the end of the tongue 19.

It will be seen from the drawing that the end of the outer turn of a balance-spring 21 is secured to the supporting element 24*a*. This spring end is guided by the tongue 19 and abuts the inner edge of the beak 18 while resting upon the tongue 17. Having been placed in position without any deformation, owing to proper fitting, the balance-spring 21 is secured to the element 24*a* by laser welding, for example, the laser beam having been aimed in a substantially radial direction with respect to the balance-spring 21, from the outside, through the space between the beak 18 and the tongue 19. It will be noted that the heights of the tongue 19 and of the beak 18 will preferably be slightly less than the width of the blade of the balance-spring 21, so that the latter will project above the elements 18 and 19 for part of its height. This embodiment makes it possible to weld the balance-spring 21 by aiming the laser beam substantially parallel to the axis of the balance.

FIG. 4 shows a supporting element 34*a* disposed, with respect to a stud-support analogous to the stud-support 8, in the same manner as the supporting element 24*a*. Its base is blanked and bent to form an oblique wing 22 and a substantially vertical wing 23. The wings 22 and 23 define a V-shaped groove 25, with the oblique wing 22 situated outside a balance-spring. The outer end 31 of the balance-spring is engaged in the groove 25 and preferably does not rest against the wing 23, thus avoiding stress in the balance-spring. The spring end 31 is secured to the element 34*a* by a mass of cement 27 which fills the V-shaped groove 25 at least partially. The cementing operation is, of course, carried out by placing the balance-cock with the stud-support in a position where the groove 25 opens out upwardly and forms a recipient for the cement 27. It is possible to use either a liquid cement which is solidified by drying or heating, or a solid cement which is liquefied by heating and resolidifies upon cooling. In this embodiment, too, the balance-spring is fixed without deformation. The portion 26 of the element 34*a* which is situated at a maximum radius from the axis of the balance is broadly rounded to prevent snagging of the balance-spring in the event of a shock.

In the three embodiments described above, the support member for the balance-spring may be shaped solely by blanking and bending or stamping operations. If need be, the various fixing elements which support and guide the balance-spring during positioning, such as the beak 18 or the wings 22 and 23, might also be formed by manufacturing methods other than blanking and bending, e.g., by milling, stamping, etc.

The arrangement described makes it possible to produce a stud-support made in one piece with a supporting element, and one to which the outer end of the balance-spring is permanently secured without deformation. This stud-support may be fitted on the balance-cock and dismantled at will, allowing the oscillator to be separated from the movement for purposes of repair or overhaul.

The stud-support may be made in one piece with the supporting element, solely by blanking and bending or stamping operations, starting from a thin metal plate. When bonding is achieved by laser welding, this plate will preferably be made of steel. Its thickness, on the order of 0.15 mm., easily makes it possible to obtain precise shaping of all its parts, particularly the tongues or wings for ensuring proper positioning of the balance-spring during bonding. The stud-support may be fitted on the balance-cock so as to be fixed or to be rotatingly adjustable about the axis of the balance.

What is claimed is:

1. In a mechanical watch movement in which a balance-cock supports a balance arranged to pivot in bearings about a fixed axis, and a balance spring is fixed at its inner end to said balance and at its outer end to a bent arm of a thin, blanked plate-like support member detachable from the remainder of the said movement, the improvement wherein said bent arm terminates in a one-piece substantially planar lower end section which comprises:

a first substantially planar section which extends parallel to the balance axis;

a second substantially planar section connected directly at its upper end to and extending downwardly and radially outwardly from the lower end of the first section, said second section comprising a first part transversely coextensive with the first section and a second part extending transversely from the first part; and a third substantially planar section connected directly at its upper end to, being transversely coextensive with, and extending downwardly from the upper end of the second part of the second section, said third section being coplanar with said first section;

said third section and said second part of said second section defining an imperforate downwardly and radially outwardly opening V-shaped groove therebetween;

the outer end of said balance spring being in said groove; and a mass of cement at least partially filling said groove and securing the outer end of said balance spring to said lower end section of said bent arm.

* * * * *